United States Patent [19]

Paajanen et al.

[11] 4,015,114

[45] Mar. 29, 1977

[54] LIGHTING FITTING

[75] Inventors: Paavo Antero Paajanen; Pentti Kauko Tapani Väänänen, both of Iittala, Finland

[73] Assignee: A. Ahlstrom Osakeyhtio, Finland

[22] Filed: Oct. 14, 1975

[21] Appl. No.: 621,832

[30] Foreign Application Priority Data

Dec. 20, 1974 Finland ..... 743739

[52] U.S. Cl. ..... 240/47; 55/316; 55/385 R; 55/487

[51] Int. Cl.[2] ..... F21V 29/00

[58] Field of Search ..... 55/316, 385 R, 467, 55/471–473, 487; 240/47, 25

[56] References Cited

UNITED STATES PATENTS

| | | | |
|---|---|---|---|
| 3,457,399 | 7/1969 | Milroy | 240/25 |
| 3,691,365 | 9/1972 | Sequerra et al. | 240/47 |
| 3,755,665 | 8/1973 | Grindle | 240/25 |
| 3,944,403 | 3/1976 | Simpson et al. | 55/316 |

FOREIGN PATENTS OR APPLICATIONS

| | | | |
|---|---|---|---|
| 212,937 | 4/1941 | Switzerland | 55/316 |

*Primary Examiner*—Bernard Nozick
*Attorney, Agent, or Firm*—Bucknam and Archer

[57] ABSTRACT

In a lighting fitting having a closed construction wherein the inner spaces of the various parts communicated with each other said inner spaces are connected to the surrounding space through a filter containing filter elements retaining dust and other particles and filter elements adsorbing gases.

1 Claim, 1 Drawing Figure

LIGHTING FITTING

FIELD OF THE INVENTION

The present invention relates to a lighting fitting of a closed construction, especially meant for use in an industrial environment containing dust, smoke, gas, and vapor.

DESCRIPTION OF THE PRIOR ART

A lighting fitting used in an industrial environment in time gets soiled, which results, among other things, in poorer lighting efficiency. A lighting fitting gets soiled both on the outside and on the inside. The outer surface of the glass of a lighting fitting is relatively easy to clean, but cleaning its inner surface, the reflector surface and the bulb is more problematic. Attempts have been made to prevent the inside of a lighting fitting from getting soiled by sealing the seams of the fitting as well as possible. The temperature of the air in a lighting fitting is high when the light is on, and it cools to a value corresponding to the outside temperature when the light is turned off. This causes a considerable change in the pressure inside a lighting fitting every time the electricity is cut off. Creating a completely airtight construction to prevent air from entering the lighting fitting as it cools is in practice impossible.

The inside soiling of a lighting fitting is a very harmful phenomenon. In addition to the inside cleaning of a lighting fitting being complicated and therefore performed at lengthy intervals, dust on the reflecting surface of the lighting fitting may burn onto it under the effect of the high temperature and thereby cause permanent damage. The detrimental effects of corrosive gases in the environment on the various surfaces of a lighting fitting, e.g., the electric connections and the reflector, has also long been a problem for which a solution has been sought.

Activated carbon filters have been used for purifying the air which enters a lighting fitting. The effect of such a filter is, however, limited to adsorbing certain gaseous or vaporous impurities present in the air, but it does not bind dust or aerosols such as smoke. In known solutions, an activated carbon filter has been placed between the coupling part and the bulb chamber of a lighting fitting, in which case unpurified air enters the coupling part when the lighting fitting cools. Replacing an activated carbon filter in such a case is difficult and may therefore be neglected.

SUMMARY OF THE INVENTION

The object of the present invention is to provide a lighting fitting of a closed construction, wherein the environmental dust and gases are effectively prevented from entering the inner parts of the lighting fitting.

The solution according to the invention is characterized in that a combined dust and gas filter is used for purifying the air entering the lighting fitting. The filter of a gas mask has proven very suitable for this purpose. It is a general filter which adsorbs most industrial gases and retains 99.99% of the particles with a granule size of 0.01–0.5 $\mu$m. It is mass produced, and consequently its purchasing price is low. It is easily available everywhere so that spare parts are guaranteed. It is easy to install and replace since it is attached by means of one gasketed threaded joint. The dimensions of the threading have been standardized so that filters meant for other purposes than gas masks also fit the lighting fitting if the conditions so require. In Scandinavia and many other countries the same threading dimensions are used in corresponding filters, which is of great importance considering the export of the lighting fittings.

The filter is preferably fitted to the ballast casing of the lighting fitting so that the bulb can be replaced without detaching the filter and vice versa. Thereby the parts in the ballast casing are also protected from dust and corrosive gases. Since the parts inside the lighting fitting are not exposed to corrosive gases or vapors, the requirements set for their materials or surface treatment are not as strict as in conventional closed lighting fittings. This lowers the production costs. The greatest economic advantage lies, however, in that it has been possible to eliminate the reduction of lighting efficiency due to the soilage of the inside of the lighting fitting.

SHORT DESCRIPTION OF THE DRAWING

The accompanying drawing shows a partial section of a side view of a lighting fitting in accordance with the invention.

DESCRIPTION OF THE PREFERRED EMBODIMENT

Figure 1:
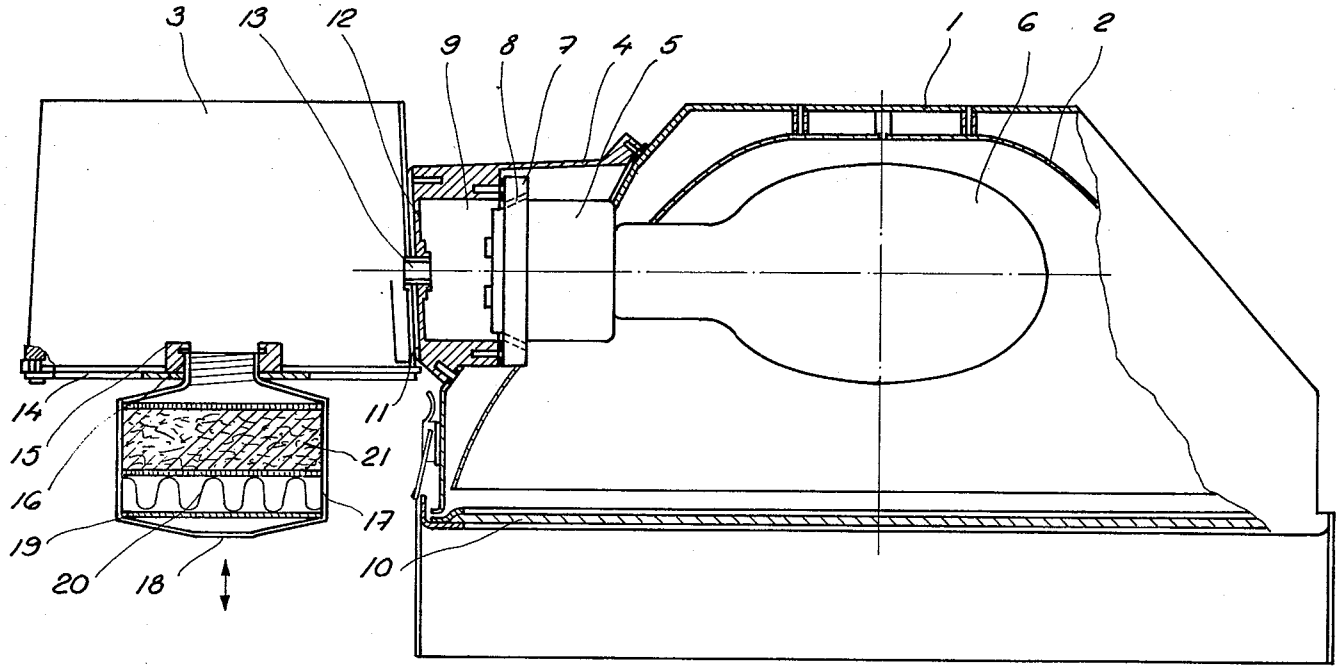

In the drawing, 1 refers to a lamp shade having a reflector 2 secured to the inside thereof. Number 3 indicates a ballast casing, which contains, i.a., the ballast, not shown in detail the electric wires with their connector, and other electric equipment. The ballast casing 3 and the lamp shade 1 are attached tightly to each other by means of a follow intermediate piece 4, to which a bulbholder 5 and a bulb 6 have been fitted. The bulb-holder 5 has a collar 7 having perforations 8 which connect the cavity 9 in the intermediate piece 4 to the space limited by the lamp shade 1 and a protective glass 10 tightly secured therefor. The wall 11 of the ballast casing 3 and the end 12 of the intermediate piece 4 have an opening to which a sealing sleeve 13 has been fitted. The latter connects the cavity 9 in the intermediate piece to the space limited by the ballast casing and its cover 14. In the cover 14 there is a threaded collar 15 into which the attachment part 16 of a filter has been screwed. The filter comprises a casing 17 having an opening 18 in the end opposite to the attachment part 16 through which opening the filter, the ballast casing 14 and the intermediate piece 4 are connected to the surrounding space. In the filter casing 17 there is a filter element 19 to retain rough dust, and a fine-pored filter element 20 to retain fine dust, smoke and vapor. In addition there is a filter element 21 containing activated carbon to adsorb gases.

The filter is placed at such a distance from the heat-generating bulb that it remains relatively cool, which is advantageous in terms of its filtering efficiency.

The combination works as follows. When the light in the lighting fitting is on, the bulb heats the air in the bulb chamber, thereby producing an increased pressure, which causes air to flow through the filter opening 18 into the surrounding space. The flow stops when a state of balance has been reached. When the light is turned off, a reverse phenomenon is created and air from the environment enters the lighting fitting. Since the temperature lowers slowly when the lighting fitting cools, the rate of the air flow through the filter is low and the difference between the inside and outside pressures of the lighting fitting is small. Therefore the tightness of the seams between the parts is not critical.

EXAMPLE

Industrial lighting fitting with power of 400 W
Lighting fitting volume 36 l
Average air temperature when bulb is burning 100° C
Temperature of surrounding air 20° C
Cooling period 1.5 h
Rate of air flow into lighting fitting 0.13 l/min
Pressure loss in filter 0.3. mm $H_2O$ It is clear that the principles of the invention can also be applied by using filters of other types than the general filter suggested above.

We claim:

1. A light fitting comprising a ballast casing enclosing first means for communicating with a source of electrical current, a large shade provided with a reflector, second means connecting the ballast casing with the lamp shade, a bulb holder and a bulb mounted on said bulb holder, said bulb holder being located on said second means, third means defining a chamber surrounding said bulb, the ballast casing having a cover and defining together with said cover a cavity, a filter connected with said cover, said filter being placed away from said bulb whereby it is not substantially heated by the heat generated by the bulb when the light is on, fourth means for communicating said bulb chamber with the cavity defined by said ballast casing and said cover, an orifice in said filter located opposite said cover, said orifice providing for the flow of air from the bulb chamber to the surrounding when the light is on and when the air in the bulb chamber is under increased pressure and providing for the flow of air from the surrounding into the bulb chamber when the light is turned off and the pressure in the interior of the bulb chamber becomes lower than the pressure in the surrounding, said filter comprising filter elements retaining dust, smoke and vapor and activated carbon as a filter element adsorbing gases, said filter being connected to said cover by means of a threaded joint, the filter being a casing of large diameter as compared with the size of the threaded joint.

* * * * *